US005669571A

United States Patent [19]

Graybill

[11] Patent Number: 5,669,571

[45] Date of Patent: Sep. 23, 1997

[54] ELECTRICAL CORD STORAGE AND DISPENSING ORGANIZER

[76] Inventor: Larry Dean Graybill, 1995 Stoney Battery Rd., Troutville, Va. 24175

[21] Appl. No.: 566,939

[22] Filed: Dec. 4, 1995

[51] Int. Cl.[6] ..... B65H 75/48

[52] U.S. Cl. ..... 242/378.1; 242/378.4; 242/379; 242/385.4

[58] Field of Search ..... 242/379, 378–378.4, 242/385.1, 385.4, 388.1, 388.5, 388.6, 396.1; 206/391, 394

[56] References Cited

U.S. PATENT DOCUMENTS

| | | | |
|---|---|---|---|
| 447,889 | 3/1891 | Matteson | 242/378.3 |
| 1,551,785 | 9/1925 | Baron | 242/378.3 |
| 2,678,779 | 5/1954 | Bellmer | 242/379 |
| 2,776,644 | 1/1957 | Fontaine | 242/385.4 |
| 3,233,591 | 2/1966 | Rogers et al. | 242/385.4 |
| 3,381,916 | 5/1968 | Edgell | 242/379 |
| 4,558,835 | 12/1985 | Sunaoka | 242/7.09 |
| 4,635,865 | 1/1987 | Arnold | 242/7.03 |
| 4,725,017 | 2/1988 | Camardella | 242/7.15 |
| 4,773,623 | 9/1988 | Nabinger | 242/384.7 |
| 4,817,888 | 4/1989 | Arnold | 242/7.09 |
| 4,901,938 | 2/1990 | Cantley et al. | 242/378.1 |
| 5,314,129 | 5/1994 | Rivara | 242/7.09 |

*Primary Examiner*—John M. Jillions
*Attorney, Agent, or Firm*—John D. Gugliotta; David L. Volk

[57] ABSTRACT

An electrical cord storage and dispensing organizer is disclosed for gathering the exiting excess cords of an existing computer, thereby making the appearance around the computer's area neat and organized. Constructed mainly of plastic materials, the present organizer has rectangular shaped housing, and opens in a similar fashion to that of a briefcase. The housing contains a cordwheel, coilspring, lock button, lock spindle, compression spring, latch, and hinges. To use the present invention the latch of the top of the organizer's housing is released and the sides are moved apart in opposite directions. Turning the cordwheel approximately one turn for every foot of cord that needs to be stored within the unit will provide sufficient tension to retract the cord. A lock button holds the cordwheel with coilspring compressed. Taking a computer cord, either power or communication, and double it in half, it is then wrapped around the cord loop and close the unit. The two ends of the cord will extend from inside the box through the cord hole situated in the top of the unit. Then, a user simply pulls slightly on the cord, releasing the tension off the lock button, and retracting only the desired amount of cord.

14 Claims, 3 Drawing Sheets

ELECTRICAL CORD STORAGE AND DISPENSING ORGANIZER

BACKGROUND OF THE INVENTION

1. Field of the Invention

The present invention relates generally to wire winding devices and, more particularly, to a modular electrical cord storage and dispensing organizer for use with the numerous cords required with a personal computer.

2. Description of the Related Art

Currently in wide use today are personal computers which require a plurality of cables of various sizes and for various functions. Cables connecting a monitor to a central processor, a keyboard to a central processor, a processor to a printer, and so on are generally left extending from the back of the system and peripherals, and are not easily neatly organized. Often, these cables are left to rest on the floor, causing a situation which may result in someone tripping. Or, these cables very often may become tangled, adding to confusion should the owner need to relocate the computer or identify the cause of a malfunction.

Consequently, a need has been felt for providing an apparatus and method which can contain excess computer cable, dispense only the necessary amount of computer cable, and store unnecessary amounts of computer cable in a neat, dispensable, aesthetically pleasing, and modular arrangement.

SUMMARY OF THE INVENTION

It is therefore an object of the present invention to provide an apparatus for storing and dispensing excess electrical or communication cords used with personal computer equipment.

It is another object of the present invention to provide a cord storing and dispensing apparatus which can prevent cords for computer equipment from becoming tangled or damaged.

It is another object of the present invention to provide a cord storing and dispensing system which is modular and thereby allows for use with multiple cords.

It is yet another object of the present invention to provide a cord storing and dispensing system which can aid in the identification, relocation, or troubleshooting of cabling for computer equipment.

Finally, it is an object of the present invention to provide and aesthetically pleasing storing container for the cabling for computer equipment.

It is a feature of the present invention to provide a storage container for computer equipment cabling which can retract or dispense various lengths of cable as needed.

Briefly described according to the preferred embodiment of the present invention, a hinged, split storage container is provided housing a center shaft rotatingly supporting a cordwheel. Circumferentially arrayed about the cordwheel are a series of locking holes which engages a tensioned wheel lock button. A coilspring connects the cordwheel to the center shaft, and causes a spinning tension upon the cordwheel. A cordhole penetrates the storage container, and provides an exit conduit for a computer equipment cable. To use the present invention, the latch of the top of the organizer's housing is released and the sides are moved apart in opposite directions. Turning the cordwheel approximately one turn for every foot of cord that needs to be stored within the unit will provide sufficient tension to retract the cord. A lock button holds the cordwheel when the coilspring is compressed. Taking a computer cord (either power or peripheral communication), doubling it in half, it is hooked onto the cord loop attached to the cordwheel and the unit and latch closed. The cord will protrude out through the cord hole situated in the top of the unit. Then, a user simply pulls slightly on the cord, releasing the tension off the lock button, and retracts only the desired amount of cord.

An advantage of the present invention is that electrical or communication cords used with personal computer equipment can be stored and dispensed.

Another advantage of the present invention is that cords for computer equipment are prevented from becoming tangled or damaged.

Another advantage of the present invention is that a modular design can accommodate multiple cords.

Another advantage of the present invention is that the cord storing and dispensing system can aid in the identification, relocation, or troubleshooting of cabling for computer equipment.

Further, the present invention provides an aesthetically pleasing storing container for the cabling for computer equipment.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENTS

1. Detail Description of the Figures

Figure 1:
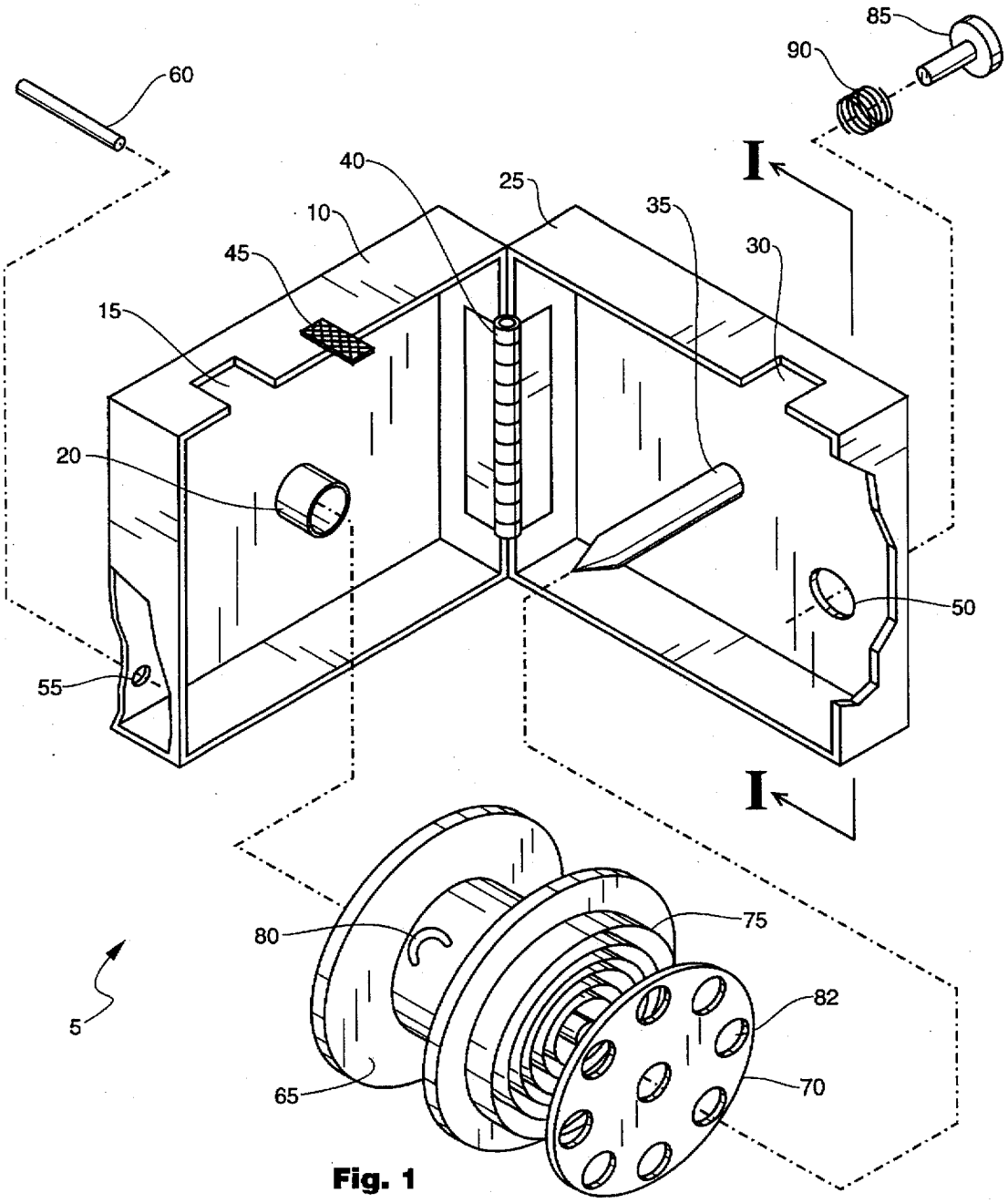
FIG. 1 is an exploded view of the preferred embodiment of the present invention.

Referring to FIG. 1, a electrical cord storage and dispensing organizer 5 is shown, according to the present invention. A left housing 10, is provided with a left rectangular opening 15 along one of its side faces. Also provided is a right housing 25 with a right rectangular opening 30 and a right center shaft 35. Both the left housing 10 and the right housing 25 are held in firm mechanical contact with a hinge 40 located along and joining together the left housing 10 and the right housing 25 along one edge. Located along the same side of the left housing 10 as the left rectangular opening 15 is found a latch 45. A lock button hole 50 is provided on the foremost face of the right housing 25 adjacent to the right center shaft 35. The function of the lock button hole 50 will be explained in greater detail below. Located in each extreme corner of both the left housing 10 and the right housing 25 are connection holes 55. (Only one out of eight is shown for illustrative purposes) Each connection hole 55 is used in conjunction with a connection pin 60 for joining together multiple electrical cord storage and dispensing organizers 5 to form a modular system. Located in the direct interior of the right housing 25 and mounted radially on the right center shaft is a cordwheel 65 and a cordwheel lock spindle 70. Located between the cordwheel 65 and the cordwheel lock spindle 70 is a coilspring 75. The cordwheel 65 is provided with a cord loop 80 on its interior hub. The cordwheel lock spindle 70 is provided with a plurality of locking holes 82 along its outer perimeter. The interior end of the coilspring 75 is held in firm mechanical contact with the right center shaft 35 of the right housing 25. The exterior end of the coilspring 75 is held in firm mechanical contact with the cordwheel lock spindle 70. The cordwheel 65 is held in firm mechanical contact with the cordwheel lock spindle 70 such as when the cordwheel 65 is rotated along the radial path defined by the right center shaft 35, torque is applied to the coilspring 75 resulting in compression and thus energy stored. Finally a lock button 85 and a compression spring 90 is fastened to the lock button hole 50 of the right housing 25. The function of the compression spring 90 is to keep the lock button 85 extended away from the locking holes 82 of the cordwheel lock spindle 70 which will be described in greater detail below. It is anticipated that all components of the electrical cord storage and dispensing organizer 5 would be made from an easily machinable and formable material such as plastic with the exception of the coilspring 75 and the compression spring 90 which would be made of spring steel. It is also anticipated that the left housing 10 and the right housing 25 be of a material such as plastic that would allow for the coloring of the material to match office decore.

Figure 2:
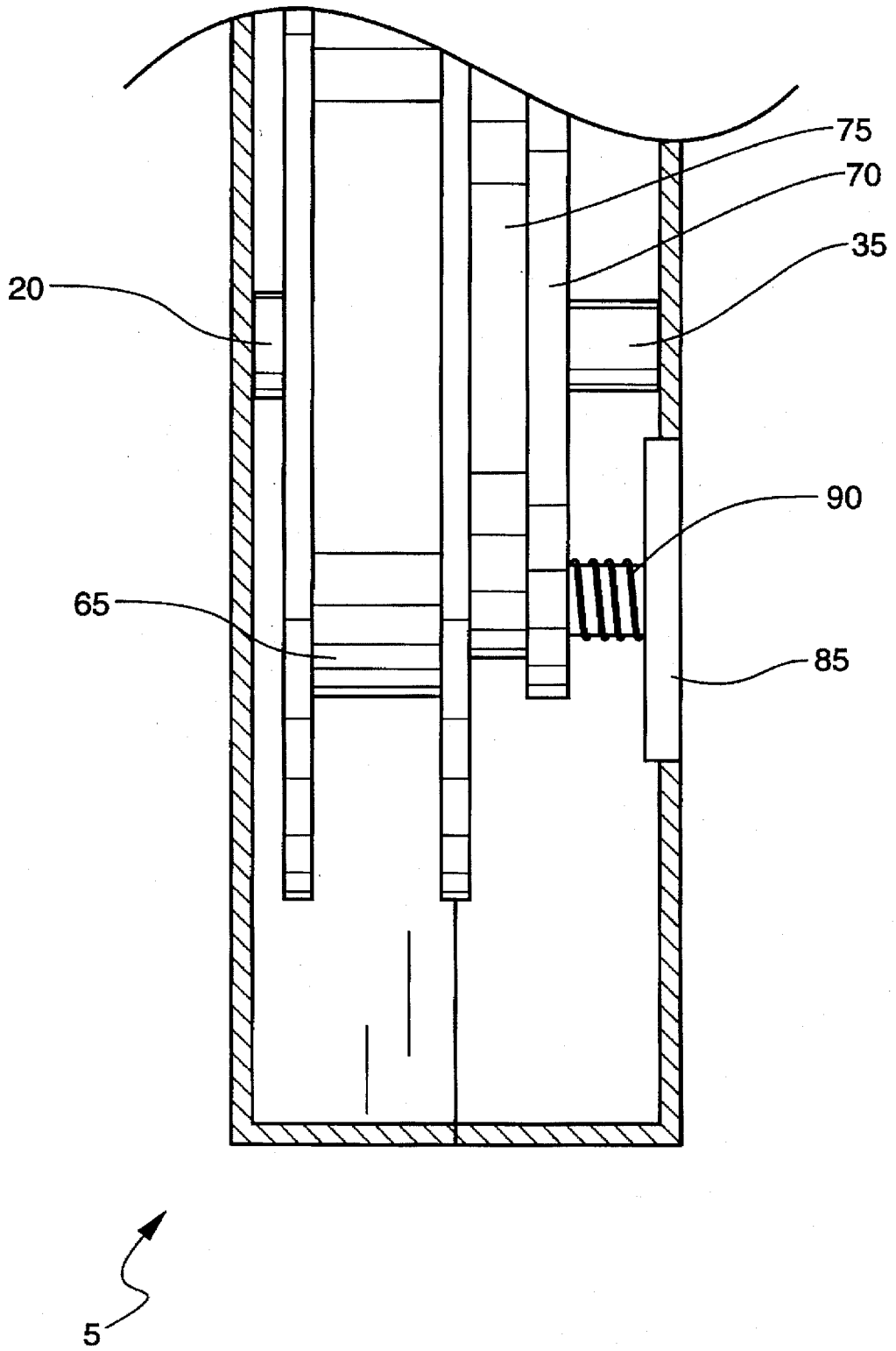
FIG. 2 is a cross sectional view of the present invention as seen along a line I—I in FIG. 1.

Referring now to FIG. 2, a cross sectional view of the electrical cord storage and dispensing organizer 5 is shown along a line I—I in FIG. 1. The cordwheel 65 is held in place by the right center shaft 35. The lock button 85 and the compression spring 90 is installed in the lock button hole 50 such that when the lock button 85 is pressed in by the user the compression spring 90 compresses and allows the lock button 85 to engage the locking holes 82 of the cordwheel lock spindle 70 thus preventing radial movement of the cordwheel 65.

Figure 3:
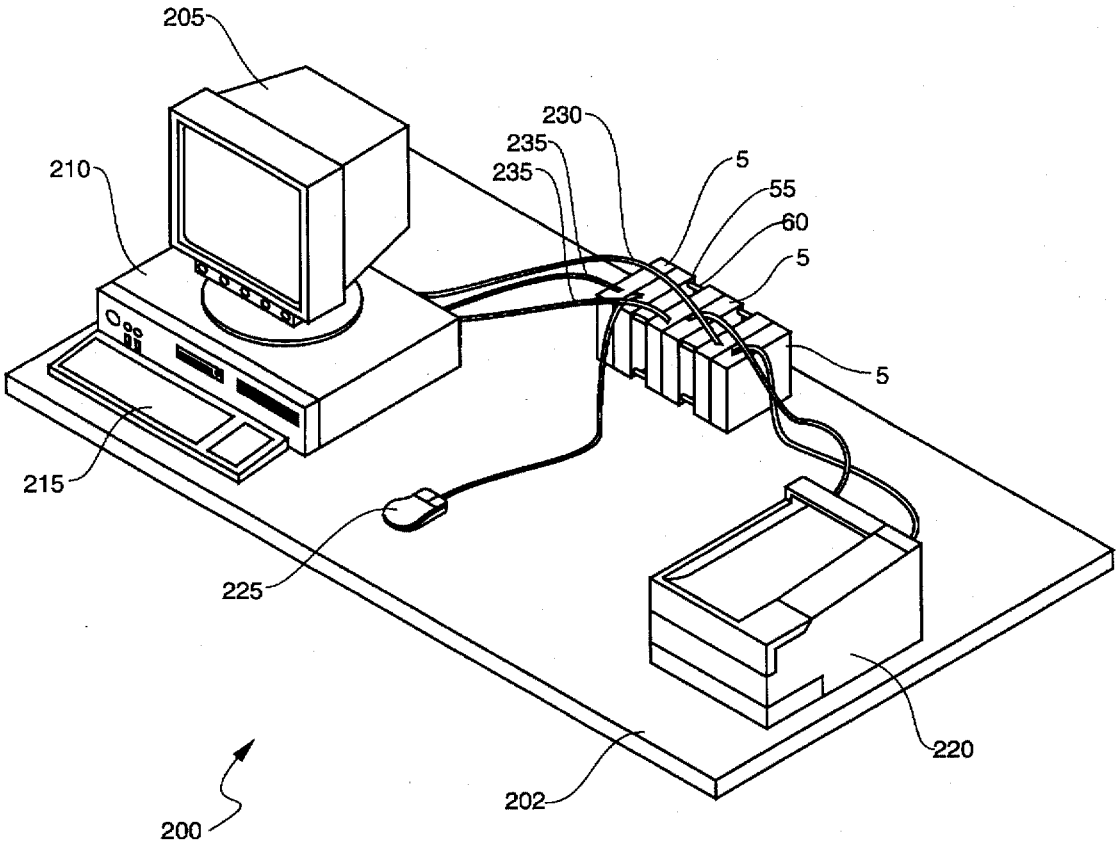
FIG. 3 a pictorial illustration of the present invention in a modular usage characterization with a personal computer system according to the preferred embodiment.

Finally, FIG. 3 shows a pictorial illustration of a electrical cord storage and dispensing organizer 5 in a modular usage characterization. A personal computer system 200 is shown on a work area table 202. The personal computer system 200 provided consists of a monitor 205, a central processing unit 210, a keyboard 215, a printer 220 and a mouse input device 225. Each electrical cord storage and dispensing organizer 5 is held in firm mechanical contact with its adjacent electrical cord storage and dispensing organizer 5 via usage of the connection pins 60 located in each connection hole 55. Stored in each electrical cord storage and dispensing organizer 5 is a electrical power cable 230 or a peripheral communication cable 235. The usage of the electrical cord storage and dispensing organizer 5 as depicted thus results in a clean and uncluttered workspace upon the work area table 202.

2. Operation of the Preferred Embodiment

In operation, the present invention can be utilized by the common user in a simple and effortless manner. To use the present invention with its preferred embodiment can best be described in conjunction with the exploded view of the preferred embodiment of the present invention as shown in FIG. 1 and the pictorial illustration of the present invention in a modular usage characterization with a personal computer system as shown in FIG. 3.

A user would open up the electrical cord storage and dispensing organizer 5 by depressing the latch 45 and separating the left housing 10 and the right housing 25 along the axis defined by the hinge 40. The user would then wind or rotate the cordwheel 65 one rotation for approximately every 12 inches of cable the user would wish to store in the electrical cord storage and dispensing organizer 5. At this point the user would then depress the lock button 85 which would thus hold the cordwheel 65 in position through the cordwheel lock spindle 70 which is engaged by the lock button 85 in its locking holes 82. The user then would take the electrical power cable 230 or the peripheral communication cable 235 and double it in half such that there are two equal lengths and engage the mid-point with the cord loop 80 of the cordwheel 65. The user would then close the electrical cord storage and dispensing organizer 5 and leave the electrical power cable 230 or the peripheral communication cable 235 extending out through the left rectangular opening 15 or the right rectangular opening 30. Next the user would pull slightly on the electrical power cable 230 or the peripheral communication cable 235 to release the tension off of the lock button 85 from the cordwheel lock spindle 70, releasing the lock button 85 and allow the electrical power cable 230 or the peripheral communication cable 235 to retract into the electrical cord storage and dispensing organizer 5. If the user wishes, multiple electrical cord storage and dispensing organizers 5 could be used to store multiple cords. In such a case the electrical cord storage and dispensing organizers 5 could be attached together in a modular fashion as shown in FIG. 3 by the use of the connection pins 60 in each connection hole 55 of adjoining electrical cord storage and dispensing organizers 5.

The foregoing description is included to illustrate the operation of the preferred embodiment and is not meant to limit the scope of the invention. The scope of the invention is to be limited only by the following claims.

What is claimed is:

1. An electrical cord storage and dispensing organizer comprising:

a split storage container, said split storage container having a first half connected to a second half via a hinge and forming an interior space;

a shaft, said shaft mounted centrally within said storage container;

a cordwheel mounted rotatingly about said shaft; a lock spindle connected to said cordwheel, said lock spindle defining a plurality of circumferentially arrayed locking holes;

a coilspring connecting said cordwheel to said shaft in a manner such as to cause a spinning tension upon said cordwheel;

a returnable wheel lock button for engaging with any said locking hole and for resisting said spinning tension caused by said coil spring upon said cordwheel; and a cordhole penetrating said storage container for providing an entrance to or exit conduit from the interior of said storage container.

2. The electrical cord storage and dispensing organizer as described in claim 1, further comprising at least one cord loop protruding from said interior hub of said cordwheel.

3. The electrical cord storage and dispensing organizer as described in claim 1, further comprising connection means for removable interlocking together said storage containers from multiple said electrical cord storage and dispensing organizers.

4. The electrical cord storage and dispensing organizer as described in claim 3, wherein said connection means comprises:

at least one connection hole penetrating said storage container; and at least one connection pin protruding from said storage contain in an aligned manner such as to engage with and be firmly held by said connection hole.

5. An electrical cord storage and dispensing organizer comprising:

a left housing having a plurality of faces, said left housing forming an open first penetration within at least one said face;

a right housing having a plurality of faces, said right housing forming an open second penetration within at least one said face;

a right center shaft mounted protrudingly from the center of said right housing;

a hinge firmly connecting said left housing to said right housing in an aligned manner such that said left housing aligns with and engages to said right center shaft;

a latch connecting, securing, and closing said right housing to said left housing;

a cordwheel lock spindle mounted rotatably about said right center shaft; and a cordwheel having an interior hub, said cordwheel mounted axially to said cordwheel lock spindle.

6. The electrical cord storage and dispensing organizer as described in claim 5, further comprising a coilspring mounted between the cordwheel connected to the right center shaft and the cordwheel locking spindle for imparting a spinning tension ultimately to said cordwheel.

7. The electrical cord storage and dispensing organizer as described in claim 5, further comprising at least one cord loop protruding from said interior hub of said cordwheel.

8. The electrical cord storage and dispensing organizer as described in claim 6, further comprising:

a lock spindle connected to said cordwheel, said lock spindle defining a plurality of circumferentially arrayed locking holes; and a returnable wheel lock button for engaging with any said locking hole and for resisting said spinning tension caused by said coil spring upon said cordwheel.

9. The electrical cord storage and dispensing organizer as described in claim 5, further comprising connection means for removable interlocking together said housings from multiple said electrical cord storage and dispensing organizers.

10. The electrical cord storage and dispensing organizer as described in claim 5, further comprising:

at least one connection pin protruding from said left housing in an aligned manner such as to engage with and be firmly held by said said second penetration.

11. An electrical cord storage and dispensing organizer comprising:

a housing an outer surface and defining an interior space;

an opening in said outer surface for prodding access to said interior space;

cord storage means mounted within said housing for storing wound electrical type cords;

spinning means mounted to said cord storage means for imparting a spinning tension to said cord storage means;

locking means accessible from said outer surface for engaging with said cord storage means and for opposing said spinning tension from said spinning means;

said housing comprising a left housing having a plurality of faces, said left housing forming an open first penetration within at least one said face;

said housing further comprising a right housing having a plurality of faces, said right housing forming an open second penetration within at least one said face;

said housing further comprising a latch connecting, securing, and closing said right housing to said left housing; and said housing further comprising a hinge firmly connecting said left housing to said right housing in an aligned manner.

12. The electrical cord storage and dispensing organizer as described in claim 11, wherein said cord storage means comprises:

a right center shaft mounted protrudingly from the center of said right housing in an aligned manner such that said left housing aligns with and engages to said right center shaft;

a cordwheel lock spindle mounted rotatably about said right center shaft;

a cordwheel having an interior hub, said cordwheel mounted axially to said cordwheel lock spindle; and at least one cord loop protruding from said interior hub of said cordwheel.

13. The electrical cord storage and dispensing organizer as described in claim 12, wherein said spinning means comprises a coilspring mounted between and connected to the right center shaft and the cordwheel locking spindle for imparting a spinning tension ultimately to said cordwheel.

14. The electrical cord storage and dispensing organizer as described in claim 13, wherein said locking means comprises:

a lock spindle connected to said cordwheel;

a plurality of locking holes circumferentially arrayed about said lock spindle; and a returnable wheel lock button for engaging with any said locking hole and for resisting said spinning tension caused by said coil spring upon said cordwheel.

* * * * *